United States Patent [19]

Shimizu

[11] 4,229,003

[45] Oct. 21, 1980

[54] FISHING TOY

[75] Inventor: Takeshi Shimizu, Yashioshi, Japan

[73] Assignee: Kabushikikaisha Anoa, Tokyo, Japan

[21] Appl. No.: 969,324

[22] Filed: Dec. 14, 1978

[30] Foreign Application Priority Data

Apr. 6, 1978 [JP] Japan ..... 53-44294[U]

[51] Int. Cl.[3] ..... A63F 9/00

[52] U.S. Cl. ..... 273/1 E; 273/1 M

[58] Field of Search ..... 273/1 R, 1 E, 1 M, 140

[56] References Cited

U.S. PATENT DOCUMENTS

| | | | |
|---|---|---|---|
| 2,622,366 | 12/1952 | Abplanalp | 273/140 X |
| 3,545,750 | 12/1970 | Stachnik | 273/140 X |
| 3,754,759 | 8/1973 | Breslow et al. | 273/1 R |
| 3,788,641 | 1/1974 | Lemelson | 273/1 M |
| 4,119,312 | 10/1978 | Todokoro | 273/1 R |
| 4,157,183 | 6/1979 | Meyer et al. | 273/1 R X |

*Primary Examiner*—Paul E. Shapiro

*Attorney, Agent, or Firm*—Hill, Van Santen, Steadman, Chiara & Simpson

[57] ABSTRACT

A fishing toy or game has a square base which contains a rotating circular turntable representing a water tank or pond, and on which a number of magnetically attractive small toy fishes are placed as if swimming in a pond. A button-operated toy animal is swivelably fitted to each corner of the base and operates such that depression of the button brings a portion of the toy animal into momentary close proximity with the revolving turntable. Internally disposed springs quickly return the toy animal to a semi-upright position, even if the button remains depressed. A magnet is carried in the portion of the toy animal which comes into proximity with the turntable, and if depression of the button is accurately coordinated with the movement of the fishes on the turntable, the toy animal will magnetically pick up one of the fishes from the turntable.

3 Claims, 10 Drawing Figures

FISHING TOY

BACKGROUND OF THE INVENTION

1. Field of the Invention

This invention relates to recreational toys and games, and more particularly to a magnetic fishing toy.

2. Description of the Prior Art

Presently available fishing toys employ a base with a rotatable turntable on which a number of toy fishes with pegs are placed. Miniature fishing rods and lines are employed to hook the fishes by their pegs. Because the ends of the miniature fishing lines quiver with the revolving motions of the turntable, a very high degree of skill must be developed to successfully hook a fish, making the toy exceedingly difficult for use by most younger persons. A further disadvantage of this type of fishing toy is that the fishing rods, lines and hooks are furnished separately from the turntable base, and may thus be easily lost or broken.

SUMMARY OF THE INVENTION

The present invention embodies a rotating turntable disposed in a cylindrical cavity in a base, the combination serving as an imaginary water tank or pond. A plurality of toy fishes, each containing magnetically attractive material, are placed on the turntable. Cylindrical receptacles are disposed at each of the four corners of the base, each receiving a cylindrical extension of a second, smaller base on which a movable toy animal is mounted. The base on which the animal is mounted can thus rotate about the central axis of the cylindrical recptacle and extension.

The toy animals are comprised of a body portion and a head portion, connected by a lever which is pivotally attached at each end to pins carried inside the body and head portions. A spring carried inside the body portion and attached to the lever maintains the lever and the head carried thereon in an upright position.

The body portion of the toy animal has a flange which extends into the toy animal base portion, and is pivotally attached therein. A spring attached to the flange also maintains the body in a normally upright position. A button is pivotally attached to the toy animal base and has a lever extending therefrom inside the base. The lever is disposed such that depressing the button pushes the lever against the flange attached to the body portion and works against the spring tension to move the toy animal out of the upright position toward the revolving turntable. The weight of the toy animal head also works against the spring in the body portion of the toy animal, and allows the head to move closely adjacent the revolving turntable. A magnet carried in a portion of the head attracts the fishes on the turntable and, if accurately positioned, will remove a fish from the turntable.

The springs are of sufficient tension such that the movement of the portion of the toy animal containing the magnet toward the revolving turntable occurs quite quickly, and the magnet is in proximity with the turntable only momentarily. A degree of eye-hand coordination is thus required to accurately position the toy animal about the swivel axis, and to choose the opportune moment to depress the button to capture a fish. The motion of the toy animal moving toward the revolving turntable approximates that of a bird dipping into the water, and the toy animals may be designed to further this image.

DESCRIPTION OF THE PREFERRED EMBODIMENTS

Figure 1:
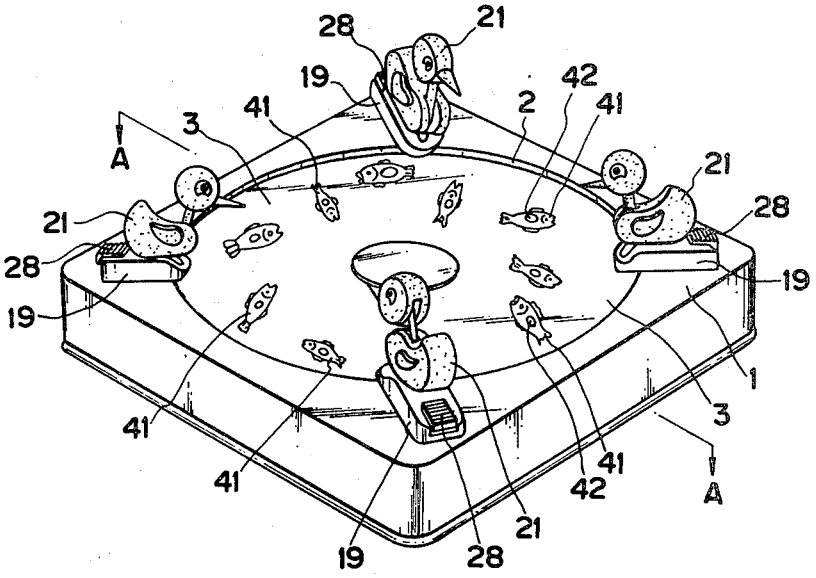
FIG. 1 is a perspective view of a fishing toy.
Figure 2:
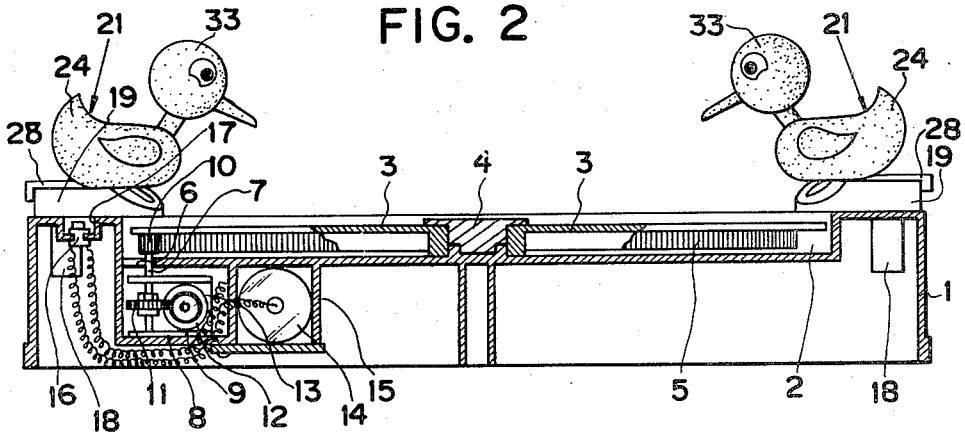
FIG. 2 is a sectional view taken on the line A—A of FIG. 1.

FIG. 1 shows a base 1 simulating a water tank or pond. The base 1 has a circular cavity 2 centrally disposed therein. A turntable 3 is fixed on a pivot of rotation 4 at the center of the cavity 2. A gear 5 is disposed below and attached to the turntable 3. The diameter of the gear 5 is less than that of the turntable 3.

An aperture 6 is bored through the base of the circular cavity 2. A shaft 7 passes through the aperture 6 and is vertically maintained by a frame 9 in a compartment 8 in the base 1. A head gear 10 is attached to the upper end of the shaft 7. The head gear 10 meshes with the gear 5. A worm gear 11 is attached to the middle of the shaft 7 in the frame 9. A worm 12 is carried on the drive shaft of a motor 13 which is also in the compartment 8. The worm 12 meshes with the worm gear 11. A cell battery 14 in a compartment 15 under the circular cavity 2 powers the motor 13.

A switch 16 is held in a recess 17 in the upper surface of the base 1. The switch 16 is electrically connected both with the cell battery 14 and with the motor 13 to start and stop the motor 13. Although not shown in the drawings, a rheostat may be interposed between the battery 14 and the motor 13 to selectively vary the speed of the motor 13, and thus the speed of rotation of the turntable 3.

A cylindrical receptacle 18 is bored at each corner of the top of the base 1. A retrieval mechanism 21 has a hollow pedestal 19 which has a downwardly extending peg 20 attached to its bottom. The peg 20 is inserted into the receptacle 18 of the base 1. The pedestal 19 can thus swivel about the vertical axis of the peg 20, and can be inserted and removed without restriction.

One side 22 of the pedestal 19 slants downwardly and has a slot 23 cut from the upper side of the pedestal 19 through the slanting side 22. A second slot 27 is cut in a portion of the top of the pedestal 19 and extends through a portion of an adjacent side of the pedestal 19 opposite the slanting side 22.

Figure 3:
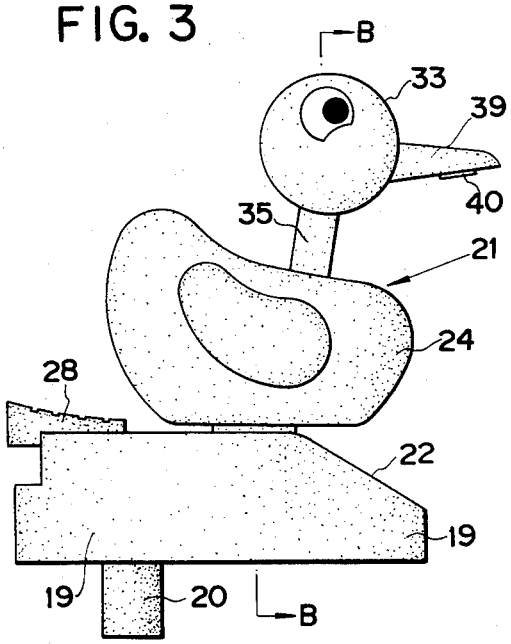
FIG. 3 is a side view of the toy animal of the present invention.
Figure 5:
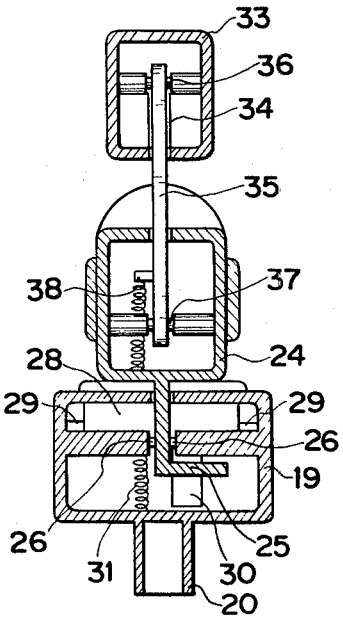
FIG. 5 is a sectional view taken on the line B—B of FIG. 3.
Figure 4:
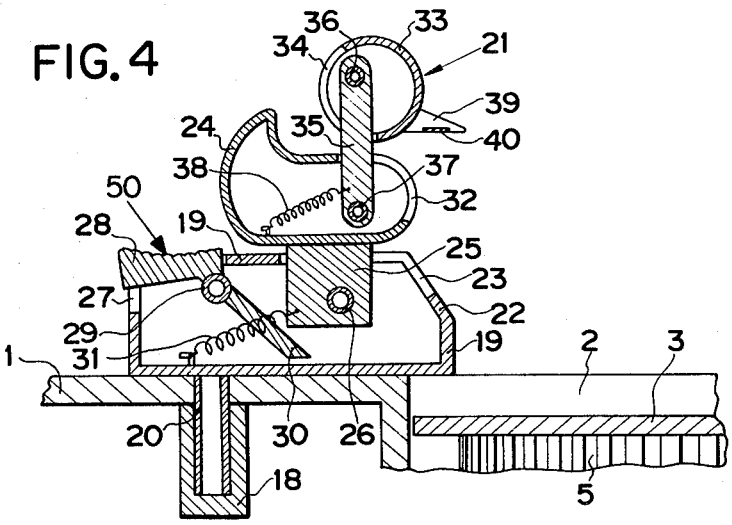
FIG. 4 is a sectional view of the toy animal attached to the base of the toy.
Figure 7A:
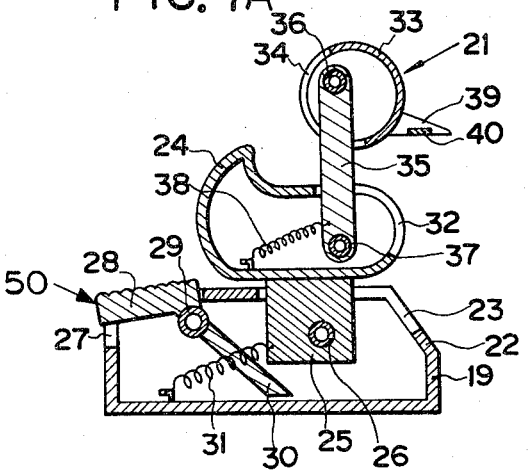
FIGS. 7*a*, 7*b*, and 7*c* are sectional views showing the position of the toy animal at three moments in sequence during operation.
Figure 6A:
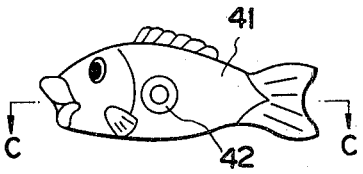
FIG. 6*a* is a front view of the toy fish of the present invention.
Figure 6B:
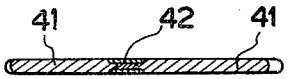
FIG. 6*b* is a sectional view taken on line C—C of FIG. 6*a*.
Figure 7B:
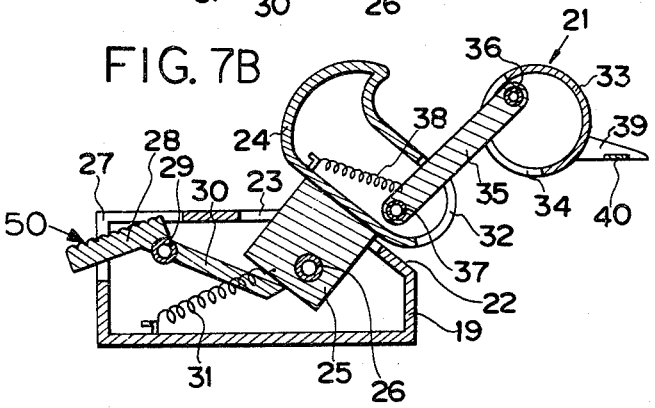
Figure 7C:
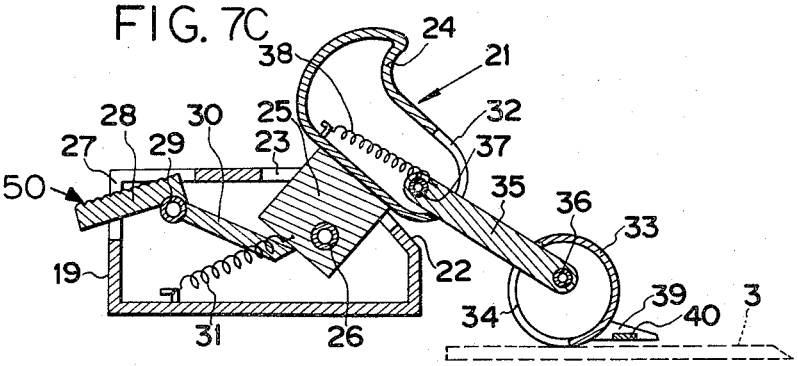

A toy animal on top of the pedestal 19 has a hollow body portion 24, a hollow head portion 33, and a connecting lever 35. As shown in sectional views in FIGS. 3 and 4, the body portion 24 has an L-shaped flange 25 extending downwardly therefrom and into the pedestal 19 through the slot 23. The flange 25 rotates about a pivot 26 inside the pedestal 19 which passes through the vertical portion of the flange 25. Thus the flange 25 is carried on the pivot 26 in a manner allowing it to freely swivel.

An actuator button 50 projects through the second slot 27 to the outside of the pedestal 19. The actuator button 50 rotates about a pivot 29, extending from the inner side walls of the pedestal 19. The pivot 29 divides the actuator button 50 into an exterior portion 28 and an interior portion 30. The interior portion 30 is a lever which projects beneath the horizontal portion of the flange 25. Depression of the exterior portion 28 rotates the actuator button 50 about the pivot 29 and pushes the interior portion 30 against the flange 25, thereby tilting the body portion 24 forward. A spring 31 is attached between one side of the flange 25 and the bottom inner surface of the pedestal 19 below the button 50 and opposes movement of the flange 25 out of a vertical position.

The body 24 of the toy animal has a slot 32 cut from the upper face of the body 24 through the front face of the body 24. The head 33 has a slot 34 cut from the back surface of the head 33 through the bottom surface of the head 33. A connecting lever 35 has one end which rotates on a pivot 36 within the head 33 and another end which rotates on the pivot 37 within the body 24. The lever 35 passes through the aligned slots 32 and 34 to connect the head 33 to the body 24. A spring 38 is attached between the neck 35 within the body 24 and the lower inner surface of the body 24 and opposes movement of the lever 35 out of a vertical position.

An extension 39 protrudes from the head 33 and may resemble a bird's beak or bill. The extension 39 has a generally flat bottom surface and carries a magnet 40 which is flush with the bottom surface.

A magnetically attractive object 41 is shown in FIG. *6a* resembling a fish. The object 41 may be made entirely of magnetically attractive material or may hold a grommet 42 made of such material.

Operation of the present invention, as shown in sequence in FIGS. *7a, 7b,* and *7c,* is as follows. A number of fishes 41 are randomly placed on the turntable 3. The switch 16 is turned on to rotate the turntable 3. The fishes 41 on the turntable 3 move around as if they were swimming in water. A player keeps his or her fingers on the exterior portion of the button 28 on the pedestal 19. When a fish 41 approaches the retrieval mechanism 21 as the turntable 3 rotates, the player swivels the pedestal 19 in appropriate directions about the peg 20 and pushes the button 28 on the pedestal 19. The interior portion 30 of the actuator 50 pushes against the flange 25 causing the body 24 of the retrieval mechanism 21 to tilt forward. Gravity causes the head 33 to fall forward against the tension of the spring 38, rotating about the pivot 36, so that the beak 39 momentarily reaches down above the surface of the turntable 3. Rotation of the head 33 about the pivot 36 is such that the flat bottom surface of the beak 39 is substantially parallel to the turntable 3. The beak 39 remains in such a position only for a second, when the tension of the spring 38 overcomes the weight of the head 33 and lifts the head 33 away from the turntable 3. If the beak 39 of the retrieval mechanism 21 touches the fishes 41 during the short time while the retrieval mechanism 21 is bent toward the turntable 3, the magnetically attractive material 42 of the fish 41 is attracted by the magnet 40 under the beak 39. The fish 41 is thus held by the magnet 40 and is lifted up. An object may thus be retrieved from the turntable only when the movement of the objects on the turntable, the position of the pedestal 19, and depression of the actuator button 50 are all accurately coordinated. Although the above description and accompanying explanatory drawings show a retrieval mechanism 21 which is generally designed to resemble a duck, any other toy animal may be substituted for the duck design. The magnet 40 may be fixed to the mouth, the nose, the arms, or the legs of any toy animals which may be similarly moved adjacent the turntable. The magnet 40 on the beak 39 and the magnetic attractive material in the fish 41 may be replaced by any suitable attracting materials, such as velcro wafers. It should be understood that applicant wishes to embody within the scope of the patent warranted hereon any other such modifications as may be suggested by those versed in the art, and which reasonably and properly come within the scope of his contribution to the art.

I claim as my invention:

1. A fishing toy comprising:

a base having a generally horizonal top surface;

a turntable rotatably centrally mounted flush with and on an axis normal to said horizontal top surface of said base;

a means for rotating said turntable;

a plurality of flat, magnetically attractive objects randomly disposed on said turntable; and a plurality of manually operated spring-loaded, normally upright retrieval mechanisms each having an upper portion carrying a magnet, and having a lower portion swivelably connected to said base above said turntable and a linkage pivotally connected to respective upper and lower portions of a mechanism, said retrieval mechanisms having a spring-loading release means for momentarily causing cooperative simultaneous forward and downward movement of said upper and lower portions and said linkage to position said magnet adjacent said turntable;

such that one of said objects disposed on said turntable may by attracted by said magnet and lifted from said turntable by each said retrieval mechanism upon return to an upright position.

2. The fishing toy of claim 1 wherein said retrieval mechanism is comprised of:

a hollow pedestal having a forward slot and a rear slot cut therein, said pedestal having a cylindrical peg extending vertically from a bottom thereof, said peg mating with a cylindrical receptacle in said base such that said pedestal is swivable about a vertical axis of said peg;

a hollow body portion, having a slot cut in an upper portion thereof;

a hollow head portion, having a slot cut in a lower portion thereof;

a vertically disposed lever having two ends, said lever passing through each of said slots in said body portion and said head portion and rotatably connected at each end to pivots disposed inside said head portion and said body portion;

an L-shaped flange attached to a bottom of said body portion and extending into said forward slot in said pedestal, said flange being rotatably connected to a first pivot through a vertical portion of said flange inside said pedestal;

an actuator member comprised of an interior portion and an exterior portion rotatably joined about a second pivot inside said pedestal, said second pivot disposed such that said exterior portion extends through said rear slot in said pedestal and said interior portion extends beneath said flange such that depression of said exterior portion rotates said actuator member about said second pivot and raises said interior portion to push against said flange and thereby rotate said flange about said first pivot and tilt said body portion and said head portion toward said turntable;

an extension attached to said head portion having a flat bottom;

a magnet carried in said extension and disposed flush with said flat bottom; and means for maintaining said retrieval mechanism in a normally upright position.

3. The retrieval mechanism of claim 2 wherein said means for maintaining said retrieval mechanism in a normally upright position consists of:

a first spring disposed inside said body portion and attached at a first end to a rearward inner surface thereof and attached at a second end to said lever;

a second spring disposed inside said pedestal and attached at a first end to a rearward inner surface thereof and attached at a second end to said vertical portion of said flange;

said springs having a tension such that upon depression of said exterior portion of said actuator button said springs extend to allow said head portion to move momentarily adjacent said turntable.

* * * * *